US009266329B2

(12) United States Patent
Kuroda et al.

(10) Patent No.: US 9,266,329 B2
(45) Date of Patent: Feb. 23, 2016

(54) LIQUID EJECTION HEAD

(71) Applicant: CANON KABUSHIKI KAISHA, Tokyo (JP)

(72) Inventors: Tomotsugu Kuroda, Yokohama (JP); Kiyomitsu Kudo, Machida (JP); Yuichiro Akama, Tokyo (JP); Satoshi Kimura, Kawasaki (JP); Kyosuke Toda, Kawasaki (JP); Naoko Tsujiuchi, Kawasaki (JP); Sayaka Seki, Tokyo (JP); Yosuke Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,625

(22) Filed: May 22, 2015

(65) Prior Publication Data

US 2015/0343772 A1 Dec. 3, 2015

(30) Foreign Application Priority Data

May 30, 2014 (JP) ..... 2014-112191
Mar. 19, 2015 (JP) ..... 2015-056151

(51) Int. Cl.
*B41J 2/14* (2006.01)

(52) U.S. Cl.
CPC ..... *B41J 2/1433* (2013.01); *B41J 2002/14491* (2013.01)

(58) Field of Classification Search
CPC .. B41J 2/17509; B41J 2/1752; B41J 2/17526; B41J 2002/14491
USPC ..... 347/37, 50, 85, 86
See application file for complete search history.

(56) References Cited

U.S. PATENT DOCUMENTS 6,502,917 B1 * 1/2003 Shinada ..... D06M 13/44 347/19
7,278,721 B2 * 10/2007 Shimizu ..... B41J 2/17546 347/49
8,721,059 B2 * 5/2014 Kodama ..... B41J 2/1752 347/50

FOREIGN PATENT DOCUMENTS

JP 2007-125770 A 5/2007

* cited by examiner

*Primary Examiner* — An Do
(74) *Attorney, Agent, or Firm* — Fitzpatrick, Cella, Harper & Scinto

(57) ABSTRACT

A liquid ejection head includes an ejection section for ejecting liquid; an electrical wiring substrate having terminals to be electrically connected to the respective electrical contacts of a liquid ejection apparatus; a first loading section to be loaded with a first liquid storing container; and a second loading section to be loaded with a second liquid storing container having a width greater than that of the first liquid storing container. The wall of the liquid ejection head is provided with a rib extending in the height direction on the surface opposite to the surface mounted by the electrical wiring substrate; and the second loading section and the rib are arranged at respective positions where the second loading section and the rib overlap with each other as viewed in the direction of loading the second liquid storing container in the second loading section.

20 Claims, 7 Drawing Sheets

COMPARATIVE EXAMPLE 1

COMPARATIVE EXAMPLE 2

THIS INVENTION

LIQUID EJECTION HEAD

BACKGROUND OF THE INVENTION

1. Field of the Invention

The present invention relates to a liquid ejection head that ejects liquid such as ink for recording purposes.

2. Description of the Related Art

Liquid ejection heads having a structure adapted to be directly mounted by ink tanks, which are in other words liquid storing containers, for storing liquid (a so-called on-carriage structure) are known. Liquid ejection heads of the above-identified type include a liquid ejection substrate having a plurality of ejection ports and a housing in which a plurality of ink tanks can removably be loaded. The liquid ejection substrate is rigidly secured to the outer surface of the housing and the plurality of ink tanks are loaded in array in the inside of the housing. Each of the ink tanks contains an ink absorbent that is impregnated with ink and the ink absorbent is partly exposed to the ink outlet port of the ink tank.

Japanese Patent Application Laid-Open No. 2007-125770 discloses a liquid ejection head of the above-described on-carriage type. In the liquid ejection head disclosed in Japanese Patent Application Laid-Open No. 2007-125770, ink supply ports for supplying ink to the liquid ejection substrate are formed in the housing and a filter is arranged at each of the ink supply ports. Additionally, an electrical wiring substrate for electrically connecting the liquid ejection substrate and the liquid ejection apparatus main body is arranged on the outer surface of the housing.

The liquid ejection head disclosed in Japanese Patent Application Laid-Open No. 2007-125770 is provided with a system for supplying ink from the ink tanks to the liquid ejection substrate by pressurizing the ink absorbent at the ink outlet port of each of the ink tanks and forcing the absorbent into contact with the filter at the corresponding ink supply port of the housing at the time when the ink tanks are loaded in the housing. Therefore, when there is not any ink tank loaded in the housing typically because all the ink tanks are removed from the housing in an operation of replacing the existing ink tanks, the filters are exposed to the outside. As the filters are exposed to the atmosphere, the water content of ink becomes liable to evaporate so that, if the filters are exposed to the atmosphere for a long period of time, ink can be caught in the meshes of the inner tissues of the filters and also at the surface layers of the filters and become hardened to consequently clog the filters.

In view of the above-identified problem, the applicant of the present patent application looked into the feasibility of additionally providing the housing of a liquid ejection head with a tank connection unit that covers the ink supply ports where filters are arranged from the atmosphere and is adapted to be connected to ink tanks. However, as a tank connection unit is added to the housing, the filters are prevented from being clogged but the liquid ejection head can be upsized and become bulky.

The applicant of the present patent application also looked in the feasibility of further additionally providing the housing of a liquid ejection head to which a tank connection unit has already been added as described above with connectors and an electrical wiring substrate for electrically connecting the ink tanks with the liquid ejection apparatus main body.

An arrangement as described below can be conceivable to realize the above-described provisions. A plurality of connectors to be electrically connected to respective ink tanks are arranged on the inner surface of a part of the lateral wall of the housing and an electrical wiring substrate to be electrically connected to the liquid ejection apparatus main body is arranged on the outer surface of that part of the lateral wall. Then, the electrical wiring substrate and the terminals of the connectors are electrically connected. Thereafter, the liquid ejection apparatus main body and the ink tanks are electrically connected to each other as the electrode pads formed on the electrical wiring substrate are pressed against the respective electrode terminals as electrical contacts formed at the side of the liquid ejection apparatus main body.

Then, however, a plurality of apertures needs to be formed in the lateral wall of the housing so as to allow the connectors to run through the lateral wall and come out to the outside of the housing. As such apertures are formed, the stiffness of the wall, to which the connectors and the electrical wiring substrate are rigidly secured, will be reduced so that the reliability of the electrical contacts between the electrode pads of the electrical wiring substrate and the electrode terminals at the side of the liquid ejection apparatus main body can be put at risk. Moreover, if apertures are not formed in the wall of the housing where the electrical wiring substrate are to be rigidly secured but the wall is liable to be deformed at the time of establishing electrical contacts between the electrical wiring substrate and the liquid ejection apparatus main body, the reliability of the electrical contacts can also be put at risk.

The wall of the housing where the electrical wiring substrate is to be rigidly secured may be provided with one or more than one rib in order to improve the stiffness of the wall. Then, however, the ink tank sitting positions need to be selected appropriately in order to avoid any interference between the ink tanks and the rib or ribs. When the ink tanks are fitted to the wall at respective positions where the ink tanks are free from the rib or ribs, the plurality of ink tanks may not be tightly placed side by side. Then, the housing may have to be upsized. Thus, when one or more than one ribs are formed on the wall of the housing to which the electrical wiring substrate is rigidly secured and a tank connection unit is additionally fitted, the liquid ejection head will inevitably become further upsized and bulky.

SUMMARY OF THE INVENTION

In an aspect of the present invention, the above-identified problems are dissolved by providing a liquid ejection head including a housing to be removably loaded with a plurality of liquid storing containers so as to be arranged in a row and an ejection section for ejecting liquid, the liquid ejection head additionally including: a plurality of liquid storing container connecting sections arranged in the inside of the housing so as to correspond to the liquid storing containers and become connected to the respective liquid storing containers in order to supply liquid to the ejection section; an electrical wiring substrate rigidly secured to the outer surface of the wall of the housing opposite to the side of arrangement of the plurality of liquid storing container connecting sections so as to be electrically connected to electrode terminals; and a rib extending in a direction intersecting the direction of sequential placement of the plurality of liquid storing containers on the inner surface of the wall opposite to the outer surface; the plurality of liquid storing container connecting sections including one or more than one first liquid storing container connecting sections, the first liquid storing container connecting section or each of the first liquid storing container connecting sections being formed so as to be connectable to a first liquid storing container but unconnectable to a second liquid storing container having a width greater than the width of the first liquid storing container as viewed in the direction of sequential placement, and a second liquid storing container connecting section formed so as to be unconnectable to a first liquid storing container but connectable to the second liquid storing container; the rib being arranged at a position located adjacent to the second liquid storing container connecting section as viewed in the direction of sequential placement correspondingly in the region of the second liquid storing container to be connected to the second liquid storing container connecting section as viewed in the width direction of the second liquid storing container.

In another aspect of the present invention, the present invention also provides a liquid ejection head including: an ejection section for ejecting liquid; an electrical wiring substrate having terminals to be electrically connected to the respective electrical contacts of a liquid ejection apparatus; a first loading section to be loaded with a first liquid storing container; and a second loading section to be loaded with a second liquid storing container having a width greater than the first liquid storing container; the wall of the liquid ejection head being provided with a rib extending in the height direction on the surface opposite to the surface mounted by the electrical wiring substrate; the rib being arranged at a position corresponding to the second loading section.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
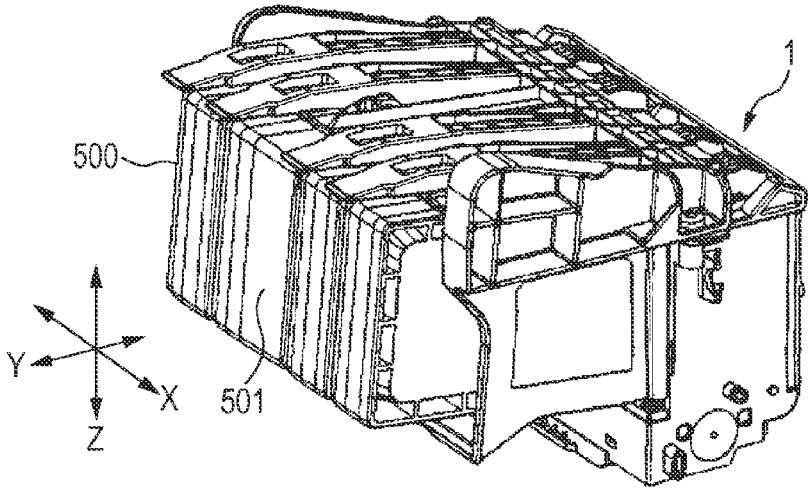
FIG. 1 is a schematic perspective view of a liquid ejection head according to the present invention in a state of being loaded with ink tanks.

FIG. 1 is a schematic perspective view of an embodiment of liquid ejection head 1 that is loaded with a plurality of ink tanks, which are liquid storing containers. The liquid ejection head 1 can be loaded with up to four ink tanks. Each of the ink tanks has a substantially rectangularly parallelepipedic profile. Of the four ink tanks loaded in the liquid ejection head 1, three (the first tanks 500) are same and identical with each other in terms of dimensions including width, height and depth. The remaining one ink tank (the second ink tank 501) also has dimensions same as those of the first ink tanks 500 except that the width thereof is greater than that of the first ink tanks 500. The first ink tanks 500 contain respective color inks that differ from each other. The four ink tanks including the first ink tanks 500 and the second ink tank 501 in a state of being loaded in the liquid ejection head 1 are arranged in a row in the width direction of the ink tanks. Note that, in FIG. 1 as well as in other drawings (e.g., FIGS. 4A, 4B, 4C, 4D, 4E, 4F and 4G) illustrating a liquid ejection head 1, the X-axis illustrates the width direction and the Y-axis represents the depth direction, while the Z-axis represents the height direction.

Figure 2A:
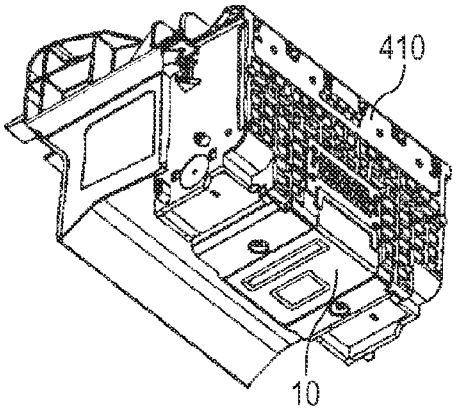
FIGS. 2A, 2B and 2C are schematic perspective views of the liquid ejection head in a state of being not loaded with in ink tanks.
Figure 2B:
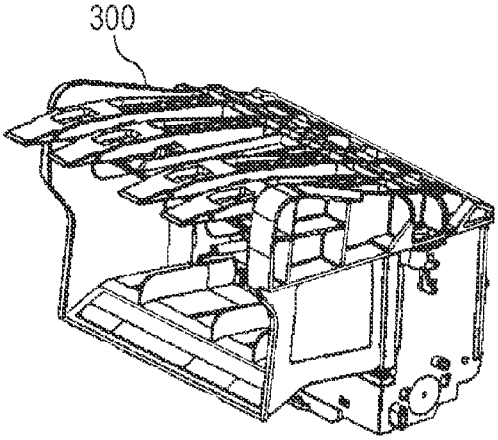
Figure 2C:
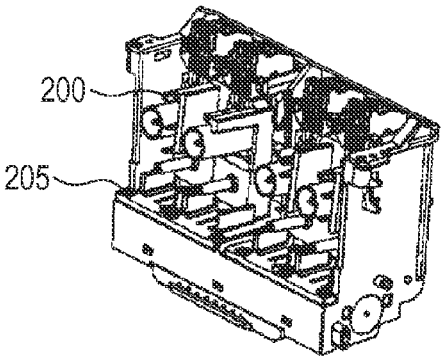

FIGS. 2A, 2B and 2C are schematic perspective views of the liquid ejection head 1 without ink tanks 500 and 501. More specifically, FIG. 2A is a perspective view of the liquid ejection head 1 as seen from below and FIG. 2B is a perspective view of the liquid ejection head 1 as seen from above, while FIG. 2C is a perspective view of the liquid ejection head 1 similar to FIG. 2B but the tank fixation units are removed from the liquid ejection head 1 illustrated in FIG. 2B. As illustrated in these drawings, the liquid ejection head 1 includes a tank fixation unit 300 for properly positioning the loaded tanks 500 and 501, tank connection units 200, each of which is to be electrically connected to the related ones of the tanks 500 and 501, and a liquid supply unit 10 for supplying liquid from the tanks connected to the tank connection units 200.

Liquid Supply Unit

Figure 3A:
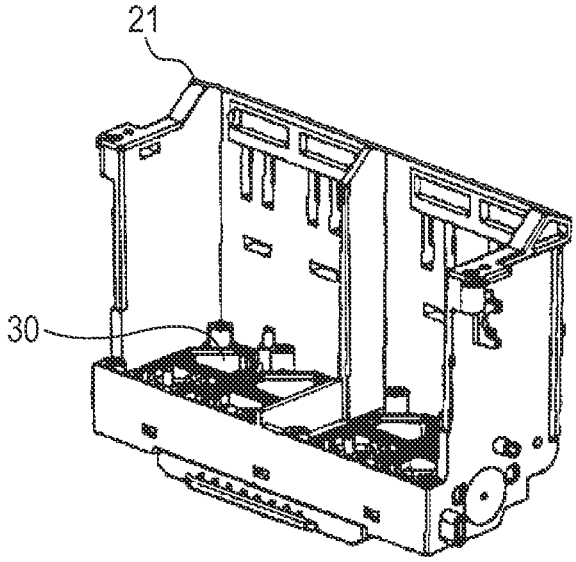
FIGS. 3A and 3B are schematic perspective views of the liquid supply unit illustrated in FIGS. 2A, 2B and 2C.
Figure 3B:
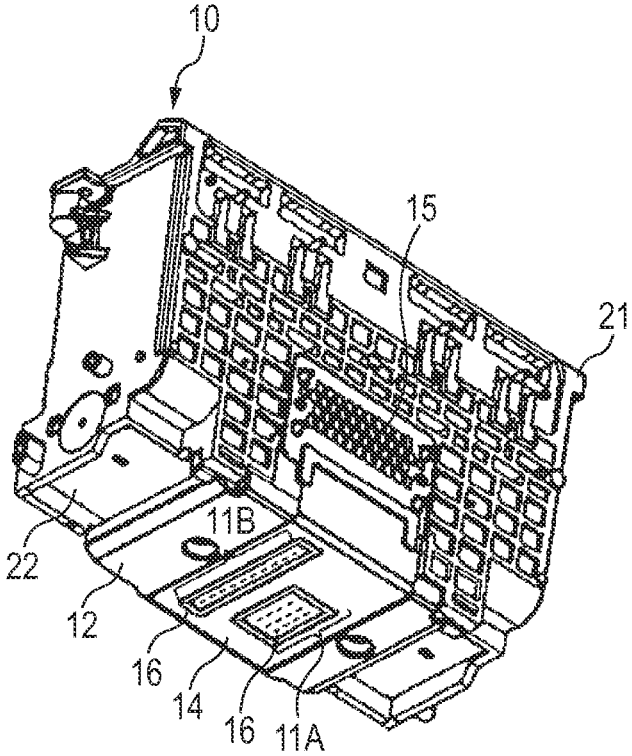

Now, the liquid supply unit 10 will be described below by referring to FIGS. 3A and 3B. The liquid supply unit 10 is formed by recording element substrates 11A and 11B, a support member 12, an electrical wiring member 14, a first electrical wiring substrate 15, a housing 21, a flow path forming member 22, a joint member (not illustrated) and filters 30.

Each of the recording element substrates 11A and 11B operates as an ejection section having a plurality of ejection ports 16 for ejecting liquid and so many electro-thermal resistance elements (not illustrated) arranged to correspond to the respective ejection ports 16. The support member 12 supports the recording element substrates 11A and 11B. The housing 21 is designed so as to be removably loaded with a plurality of tanks 500 and 501. The housing 21 has outer surfaces that substantially include only a bottom surface and a rear surface disposed adjacent to the bottom surface. The support member 12 is joined to the bottom surface of the outer surfaces of the housing 21 by way of the flow path forming member 22 and the joint member (not illustrated). Furthermore, the first electrical wiring substrate 15, which is a rigid printed wiring substrate, is rigidly secured to the rear surface of the outer surfaces of the housing 21. The electrical wiring member 14 is a flexible wiring substrate that electrically connects the recording element substrates 11A and 11B to the first electrical wiring substrate 15.

Ink supply ports are formed at the inside of the bottom of the housing 21 for the purpose of supplying ink to the recording element substrates 11A and 11B arranged at the outside of the housing 21. The ink supply ports are arranged at positions that correspond to the respective positions of the tanks 500 and 501 to be loaded in the housing 21. Each of the ink supply ports is provided with a filter 30. The above-described tank connection units 200 are fitted to the inside of the housing 21. As the tank connection units 200 are fitted to the housing 21, the ink supply ports that are provided with respective filters 30 are covered and then ink can be supplied from the tanks 500 and 501 to ink supply ports that are provided with the respective filters 30.

The recording element substrate 11A is a Si substrate having a thickness of 0.725 mm where a total of six ink supply ports are arranged in parallel. These ink supply ports are oblong groove-shaped ink flow paths. The recording element substrate 11B is arranged in parallel with the recording element substrate 11A but separated from the recording element substrate 11A. Like the recording element substrate 11A, the recording element substrate 11B is a Si substrate having a thickness of 0.725 mm where additionally a single ink supply port is formed. This ink supply port is also an oblong groove-shaped ink flow path.

In each of the recording element substrates 11A and 11B, a plurality of electro-thermal conversion elements is arranged in two rows at opposite sides of the ink supply ports and hence the ink supply ports are sandwiched between the two rows of the electro-thermal conversion elements. Additionally, electrical wires for supplying electric power to the electro-thermal conversion elements are formed typically by using aluminum (Al). The electro-thermal conversion elements and the electrical wires are formed by means of a film forming technique.

The electro-thermal conversion elements that are arranged in two rows at the opposite sides with the ink supply ports sandwiched between them are actually arranged in a zigzag manner. More specifically, the electro-thermal conversion elements of the two rows that sandwich the ink supply ports are arranged such that any two of the ejection ports 16 that respectively correspond to the rows of electro-thermal conversion elements are not found on a line running in the direction orthogonal to the direction in which the ejection ports 16 are arranged. Furthermore, electrode sections for supplying electric power to the electrical wires are arranged at the outside of the rows of the electro-thermal conversion elements.

An ejection port forming member that is made of a resin material is formed by photolithography on the surface of each of the Si substrates where a plurality of electro-thermal conversion elements are formed. Each of the ejection port forming members has an ink flow path wall where ink flow paths are formed to correspond to the electro-conversion elements and a ceiling section for covering the ink flow path wall from above. The ejection ports 16 are so formed as to be open at the ceiling section. The ejection ports 16 are arranged on the ejection port side surfaces of the recording element substrates 11A and 11B at positions located vis-à-vis the respective corresponding electro-thermal conversion elements so as to form rows of ejection ports. Thus, the ink supplied to the ink flow paths, where the electro-thermal conversion elements are arranged, is then heated as the electro-thermal conversion elements emit heat until film boiling takes place out of the ink. Then, liquid is ejected from the ejection ports 16 located vis-à-vis the respective electro-thermal conversion elements under the pressure of the air bubbles that are produced due to the film boiling.

While a liquid ejection technique of utilizing heating resistance elements (heaters) as ejection energy generating elements for ejecting liquid such as ink is employed for this embodiment, the present invention is by no means limited to such a liquid ejection technique and a liquid ejection technique of utilizing piezoelectric elements may alternatively be used for the purpose of the present invention.

The electrical wiring member 14 is for forming electric signal paths to be used to apply electric signals to the recording element substrates 11A and 11B so as to make them operate for ink ejections. Apertures are formed in the electrical wiring member 14 so as to respectively accommodate the recording element substrates 11A and 11B. Electrode terminals are formed near the edges of the respective apertures so as to be electrically connected to the respective electrode sections of the recording element substrates 11A and 11B. An electric terminal connecting section is formed near an end of the electrical wiring member 14 so as to electrically connect the electrical wiring member 14 to the first electrical wiring substrate 15 having an external signal input terminal for receiving electric signals that correspond to liquid ejecting operations by the liquid ejection head. The electrode terminals and the electric terminal connecting section are linked to each other by way of a continuous wiring pattern formed by a copper foil.

The electrical connection between the electrical wiring member 14 and the recording element substrates 11A and 11B is realized by bonding the electrode sections of the recording element substrates 11A and 11B and the electrode terminals of the electrical wiring member typically by means of a thermo-sonic bonding technique. The electrically connecting parts that connect the recording element substrate 11A and 11B and the electrical wiring member 14 are sealed by means of a first encapsulant and a second encapsulant. Then, as a result, the electrically connecting parts are protected against corrosion by ink and external impacts. The first encapsulant is employed mainly to encapsulate the connecting sections between the electrode terminals of the electrical wiring member 14 and the electrode sections of the recording element substrates 11A and 11B from the rear side of the connecting sections and also encapsulate the outer peripheral parts of the recording element substrates 11A and 11B. The second encapsulant is employed to encapsulate the connecting sections from the front side of the connecting section.

The electric terminal connecting section of the electrical wiring member 14 is electrically connected to the first electrical wiring substrate 15 by thermal bonding using anisotropic conductive film. Terminal positioning holes to be used for positioning purposes and terminal binding holes for fixation purposes are formed in the first electrical wiring substrate 15.

The joint member is made of a rubber material that will hardly be suffered from compression set. As the support member 12 and the flow path forming member 22 are subjected to compression bonding with the joint member sandwiched between them, the risk of ink leakage from the interface of the support member 12 and the flow path forming member 22 is minimized.

The filters 30 are provided to capture the dust contained in the liquid that passes through them. The filters 30 are made of non-woven fabric or stainless steel. Ink is supplied to each of the filters 30 from the related one of the ink connection units 200 that are secured to the housing 21 by means of screws 205 (see FIG. 2C).

Tank Connection Unit, Tank Fixation Unit

Figure 4A:
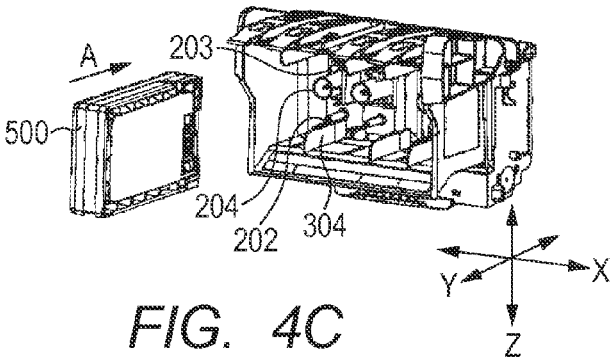
FIGS. 4A, 4B, 4C, 4D, 4E, 4F and 4G are schematic views of an embodiment of liquid ejection head according to the present invention, illustrating the components thereof.
Figure 4B:
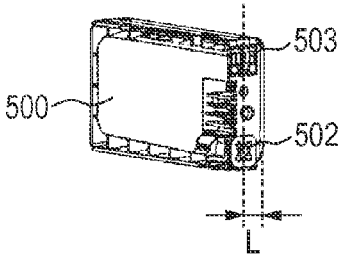
Figure 4C:
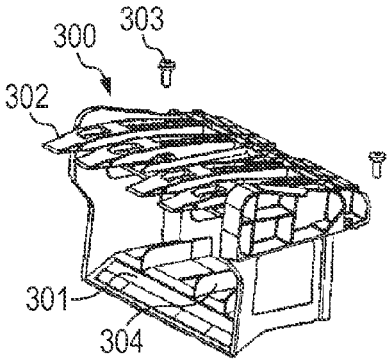
Figure 4D:
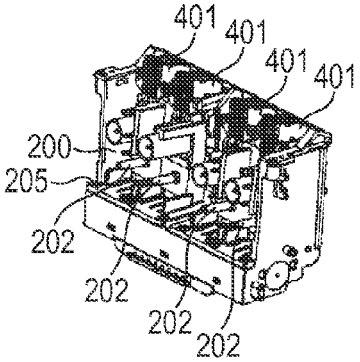
Figure 4E:
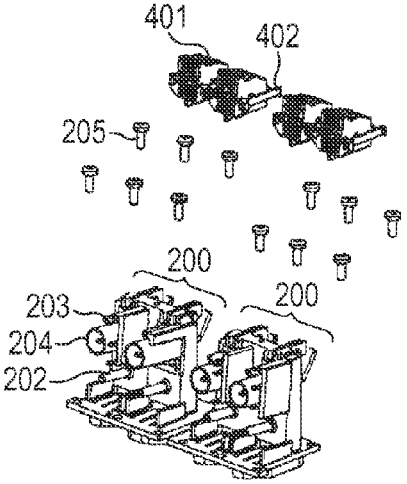
Figure 4F:
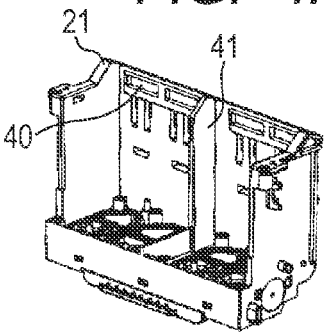
Figure 4G:
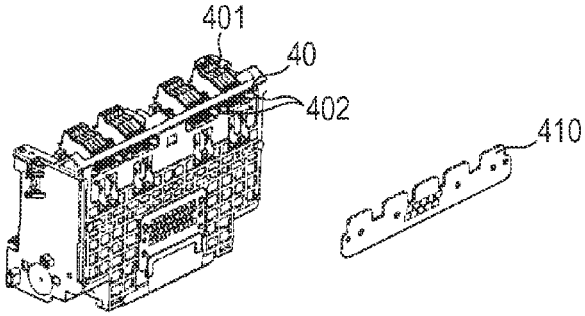

Now, the tank connection units 200 and the tank fixation unit 300 will be described below by referring to FIGS. 4A through 4G. FIG. 4A schematically illustrates how a tank 500 is loaded in a liquid ejection head 1 according to the present invention, FIG. 4B is a schematic perspective view of the tank 500 to be loaded in the liquid ejection head 1, FIG. 4C is a schematic perspective view of a tank fixation unit 300 and FIG. 4D is a schematic perspective view of the liquid ejection head 1 of FIG. 4A after removing the tank fixation unit 300 from the liquid ejection head 1, while FIG. 4E is a schematic perspective view of tank connection units 200 and connectors 401. FIG. 4F is a schematic perspective view of the liquid supply unit 10 of the liquid ejection head 1 of FIG. 4D after removing the tank connection unit 200 and the connector 401 from the liquid supply unit 10 and FIG. 4G schematically illustrates how a second electrical wiring substrate 410 formed by using a rigid member such as a printed wiring substrate and having a plurality of contacts is fitted to the rear surface side of the liquid ejection head 1. Note that the tank connection units 200 will be described below in terms of a single first tank 500.

Each of the tank connection units 200 is required to reliably supply ink from the ink outlet port of a tank 500 to the related one of the filters 30 of the ink supply unit 10. To meet this requirement, the tank connection units 200 are provided with needles 202 that are feed pipes, each of which can be inserted into the ink outlet port of a tank 500 (FIG. 4A). The tank 500 is provided at the ink outlet port thereof with a seal section 502 (FIG. 4B).

As illustrated in FIG. 4A, the tank 500 is inserted in the direction indicated by arrow A from the front side of the liquid ejection head 1 along related one or ones of the guides 304 arranged in the tank fixation unit 300. At this time, the seal section 502 of the ink outlet port of the tank 500 is brought into airtight contact with the outer periphery of the corresponding needle 202 arranged in the related one of the tank connection unit 200. Then, as a result, ink does not leak out through between the ink outlet port and the needle 202 and hence ink can reliably be supplied from the tank 500 into the liquid ejection head 1. A positioning pin 203 is provided to accurately place the ink tank 500 in position relative to the ink ejection head at the time of loading the ink tank. The ink tank 500 is properly positioned as the positioning pin 203 is inserted into the aperture arranged at an upper part of the front surface of the ink tank 500 (see FIG. 4B). The resilient members 204 illustrated in FIG. 4A are typically coil springs and, when the ink tank 500 is loaded in the liquid ejection head, the corresponding one of the resilient member 204 is compressed and hence deformed. When the corresponding one of the levers 302 illustrated in FIG. 4C is operated, the ink tank 500 is released from the liquid ejection head by the resilient force of the resilient member 204.

If ink is found on the related one of the filter 30, the ink existing on the filter 30 is preferably not solidified until the ink tank is loaded in the housing 21. For this reason, the tank connection units 200 are structurally so designed as to cover the filers 30, support the needles 202 with an appropriate degree of strength and supply the ink that passes through the needles 202 reliably to the filters 30. As a result of using the tank connection units 200, each of the filters is not exposed to the atmosphere at the time of replacing the related ink tank and remains in a state of being soaked with ink so that the risk of clogging of the filter 30 is minimized.

Each of the ink connection units 200 having the above-described configuration is designed to connect a pair of ink tanks arranged side by side in the housing 21 to the liquid ejection head 1. As described above, two ink connection units 200 are provided. Therefore, as two tank connection units 200 are arranged side by side in the housing 21 (FIG. 4E), a total of four ink tanks can be connected to the liquid ejection head 1. Alternatively, tank connection units 200, each of which is designed as a tank connection section (liquid storing container connection section) having a single needle 200 so as to be used for a single ink tank, may be provided for this embodiment. Then, each of the tank connection sections is designed either as a first tank connection section that is connectable to a first tank 500 but unconnectable to a second tank 501 or as a second tank connection section that is unconnectable to a first tank 500 but connectable to a second tank 501. A total of four connectors 401 are arranged in a row above the two tank connection units 200 in the inside of the housing 21 (FIG. 4D). These connectors 401 are arranged on the rear surface of the wall of the housing 21 where the second electrical wiring substrate 410 is arranged. Thus, the connectors 401 and the needles 202 are arranged to establish a one-to-one correspondence. In other words, with this arrangement, the ink tank connected to one of the needles 202 of the tank connection units 200 on the housing 21 can electrically be connected to a corresponding one of the connectors 401.

The connectors 401 are arranged on the wall of the rear surface side of the housing 21 and four rectangular apertures 40 for allowing the terminals of the four connectors 401 to run through the wall to the outside of the housing 21 are formed transversally in row at the wall (FIG. 4E).

A pair of snap fit joints 402 is arranged at the lateral sides of each of the connectors 401. As the pair of the snap fit joints 402 at the lateral sides of each of the connectors 401 is forced into the corresponding one of the apertures 40 and caught by the lateral sides of the aperture 40, the connector 401 is rigidly secured to the wall at the rear surface side of the housing (the inner wall surface of the housing) by the counterforce of the snap fit joints 402.

Additionally, the second electrical wiring substrate 410 is fitted to the outer rear surface of the housing 21 across the four apertures as illustrated in FIG. 4G. The terminals of the connectors 401 that come out through the respective apertures 40 are electrically connected to the second electrical wiring substrate 410.

On the other hand, as illustrated in FIG. 4C, the tank fixation unit 300 includes levers 302 that are to be engaged with the corresponding respective ink tanks and a cover 301 that holds the levers 302. The cover 301 is rigidly secured to the housing 21 by screws 303. The cover 301 is provided with guides 304 for reliably guiding the tanks 500 to the related tank connection units 200 on the housing 21. The guides 304 include upper guides and lower guides that are separated from each other in this embodiment. Alternatively, however, each of the upper guides may be connected to the corresponding one of the lower guides so as to vertically extend in the housing 21.

The principal parts of the present invention will be described below by referring to FIGS. 5 through 9D.

As described above, four apertures 40 are formed on the wall at the rear side of the housing 21 so as to allow the respective corresponding four connectors 401 to extend through them (FIG. 4G). Since the electrical wiring substrate 410 is rigidly secured to the outer surface of the wall that is opposite to the surface where the connectors 401 are arranged, the apertures 40 formed on the wall at the rear surface side of the housing 21 can remarkably reduce the stiffness of the wall.

Contact pads 410*a* to be electrically connected to the respective electrical contacts of the liquid ejection apparatus main body (not illustrated) are arranged on the second electrical wiring substrate 410. Therefore, when the contact pads 410*a* of the liquid ejection head 1 is pressed against the electrode terminals (not illustrated) at the side of the liquid ejection apparatus main body, counterforce F is generated from the electrode terminals and applied to the liquid ejection head 1. Then, at this time, the wall where the electrical wiring substrate 410 is rigidly secured is apt to warp due to the four apertures formed there. In other words, the wall can remarkably be deformed as indicated by the broken line in FIG. 5. Then, as a result, there will arise concern that the reliability of the electrical contact between the second electrical wiring substrate 410 at the side of the liquid ejection head 1 and the electrode terminals at the side of the liquid ejection apparatus main body can no longer be ensured. Besides, if the wall to which the electrical wiring substrate 410 is rigidly secured is apt to be deformed regardless of the provision of the connectors 401 and the apertures 40, the reliability of the electrical contacts of the electrical wiring substrate 410 will hardly be ensured. Therefore, the reliability of the electrical contacts of the electrical wiring substrate 410 needs to be ensured by all means.

Additionally, with the system of inserting the needles 202 of the tank connection units 200 into the respective ink inlet ports of the tanks 500 (and the tank 501) as described above, the tank connection units 200 are inevitably added to the housing 21. Thus, there will also arise concern that the liquid ejection head and hence the liquid ejection apparatus to be mounted by the ink ejection head can inevitably become upsized.

The housing 21 of the liquid ejection head 1 of this invention is so configured as to eliminate the above-identified concerns. Now, the configuration of the housing 21 will be described below.

The three first tanks 500 to be loaded in the housing are designed to be substantially the same and identical in terms of dimensions of width, height and depth. The second tank 501 has a height and a depth substantially the same as those of the first tanks 500 but has a width greater than the width of each of the first tanks 500. Particularly, note that the first tanks 500 and the second tank 501 are loaded in the housing 1 in the direction A from the front side (FIG. 4A). The tanks 500 and 501 are provided with respective ink outlet ports having respective seal sections 502 that are separated substantially by the same distance from the lateral walls of the tanks located at the left sides of the tanks when the tanks are viewed in the direction A. In other words, the ink outlet port of the second tank 501 is separated from the above-described lateral wall of the tank by a distance that is substantially equal to the distance L illustrated in FIG. 4B just like the first tanks 500.

Figure 6A:
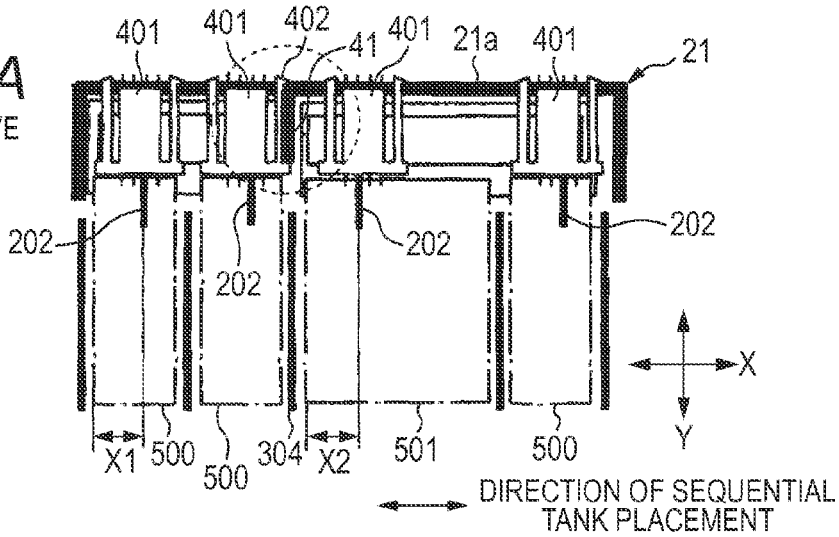
FIGS. 6A, 6B and 6C are schematic illustrations of the arrangements of Comparative Example 1, Comparative Example 2 and the present invention.

Therefore, as viewed in the X-axis direction (width direction) of the housing 21, the distance X1 between the left lateral wall of the first tank 500 and the center of the needle 202 that is inserted into the ink outlet port of the first tank 500 is substantially equal to the distance X2 between the left lateral wall of the second tank 501 and the center of the needle 202 that is inserted into the ink outlet port of the second tank 501 as illustrated in FIG. 6A. Note that the above description holds true for the ink tank arrangement illustrated in FIG. 6C.

Additionally, the first tank 500 is provided on the lateral surface thereof, where the ink outlet port is arranged, with an electrical terminal section 503 to be electrically connected with the corresponding connector 401 (FIG. 4B). Like the first tank 500, the second tank 501 is also provided with an electrical terminal section 503. Furthermore, for each of tanks, the description given earlier on the distance L with regard to the ink outlet port is also applicable to the center of the electrical terminal section 503 as viewed in the width direction of the tank.

Thus, the four connectors 401 are arranged respectively above the four needles 202 such that the center of each of the connectors 401 substantially agrees with the center of the corresponding one of the needles 202 as viewed in the width direction (X-axis direction) of the housing 21.

Note that the center position of the connector 401 to which the electrical terminal section 503 of the second tank 501 is displaced from the center of the second tank 501 in the direction of sequential tank placement (X-axis direction) just like the position of the ink outlet port of the second tank 501 where the corresponding needle 202 of the tank connection unit 200 is to be connected.

Figure 8:
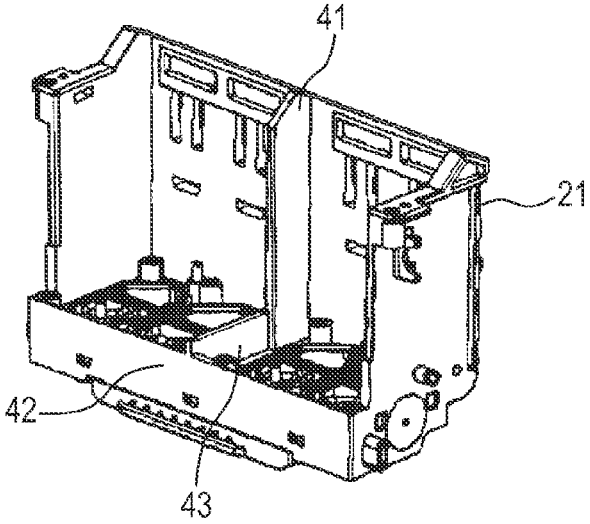
FIG. 8 is a schematic view according to the second embodiment of the present invention.
Figure 9A:
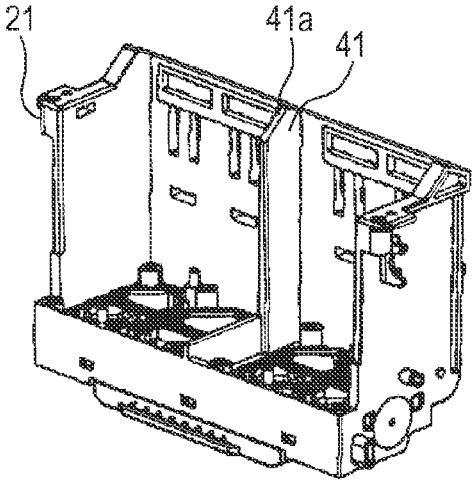
FIGS. 9A, 9B, 9C and 9D are schematic views according to the third embodiment of the present invention.
Figure 9B:
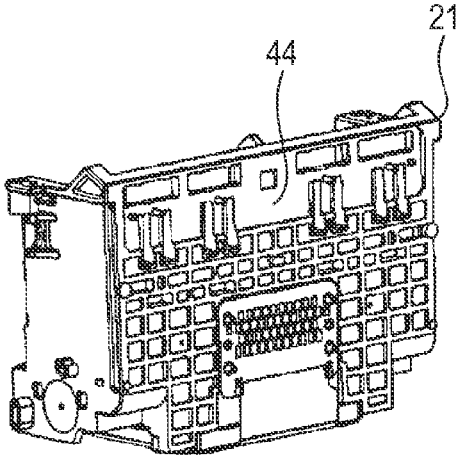
Figure 9C:
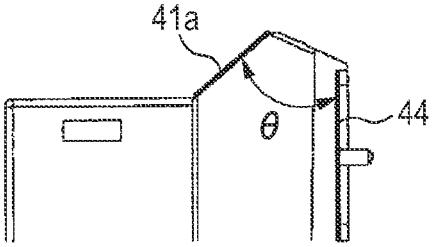
Figure 9D:
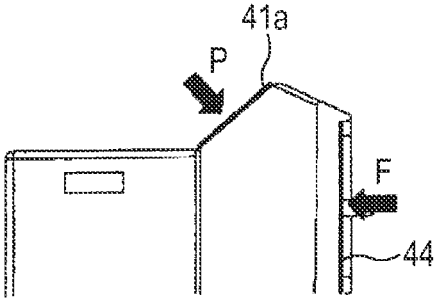

A first rib 41 is integrally formed with the housing 21 at the rear side wall 21*a* thereof. More specifically, the first rib 41 is formed as a ridge extending in a direction (the height direction of the housing 21) that intersects the direction of sequential tank placement (FIG. 8). The rib 41 is arranged on the surface of the rear side wall 21*a* (the inside surface of the housing 21) that is opposite to the surface where the electrical wiring substrate 410 is rigidly secured.

Thus, the above-identified concerns can be dissolved by defining the sitting positions of the tanks 500 and 501 and the connectors 401 and the position of the first rib 41 in the liquid ejection head 1 on the basis of the above-described arrangement. More specifically, as the rib 41 is arranged in a center region of the rear side wall 21*a* of the housing 21 (at or near the center of the rear side wall as viewed in the X-direction) as illustrated in FIG. 6C, the rib functions as a beam to improve the strength of the rear side wall. Additionally, in a state where a second tank 501 is loaded, the rib 41 is found at a position separated from the second tank 501 and located deeper (closer to the wall from which the rib 41 stands) than the second tank 501 such that the rib 41 never interferes with the second tank 501.

Figure 6B:
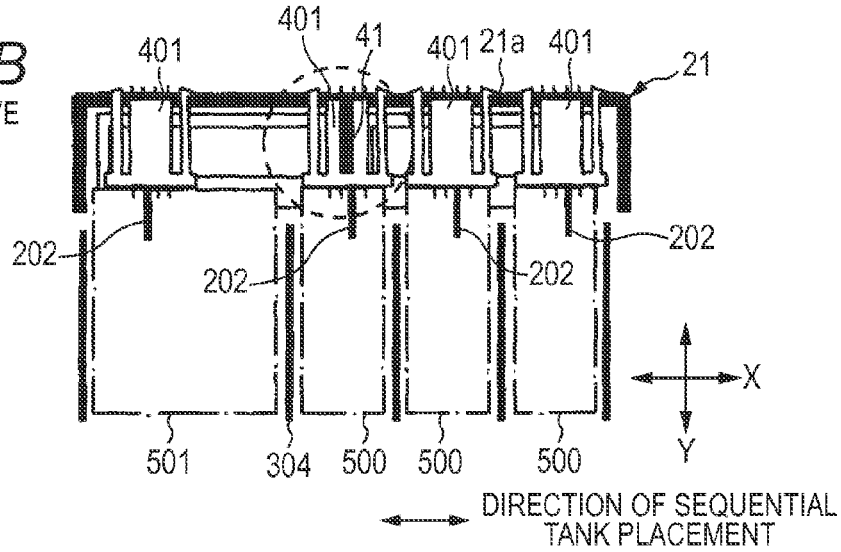
Figure 6C:
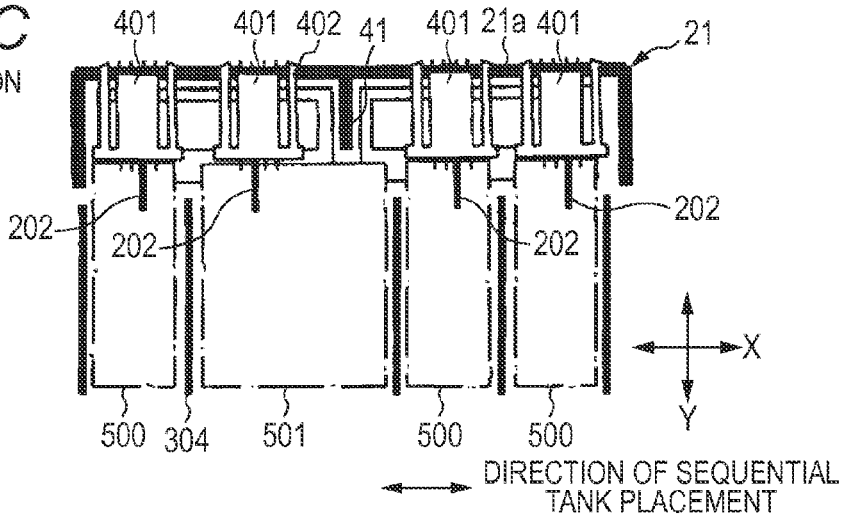
Figure 7A:
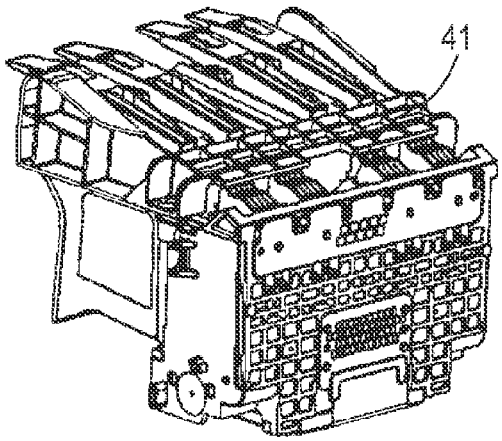
FIGS. 7A and 7B are schematic views according to the first embodiment of the present invention.
Figure 7B:
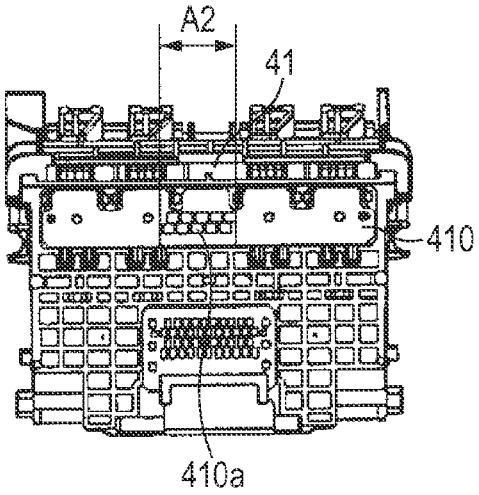

FIGS. 6A to 6C are top views schematically representing the sitting positions of the tanks 500 and 501 in the liquid ejection head 1 of the present invention. FIG. 6A illustrates Comparative Example 1 and FIG. 6B illustrates Comparative Example 2, while FIG. 6C illustrates this invention in terms of ink tank sitting positions.

As illustrated in FIG. 6A, in Comparative Example 1, a second tank 501 is placed third from the left on the housing 21. In this example, the first rib 41 is so designed as to be arranged on an extension line of the guide 304 for guiding a tank, the guide 304 being formed on the tank fixation unit (not illustrated). With this arrangement, the rib 41 does not interfere with the tanks on the housing because the rib 41 is found on an extension line of the guide 304 that is located between two adjacent tanks but interferes with the snap fit joints 402 of the connectors 401 that are located near the rib 41 (see the circle of a broken line). Then, those connectors 401 need to be shifted in either of the transversal directions (X-axis directions) to void the interference. Then, if the center of each of those connector 401 is required to agree with the center of the related one of the needles 202 in either of the transversal directions of the housing 21 as described above, each of the related needles 202 also needs to be shifted in either of the transversal directions to consequently increase the dimension of the housing 21 in the direction of sequential tank placement.

Figure 5:
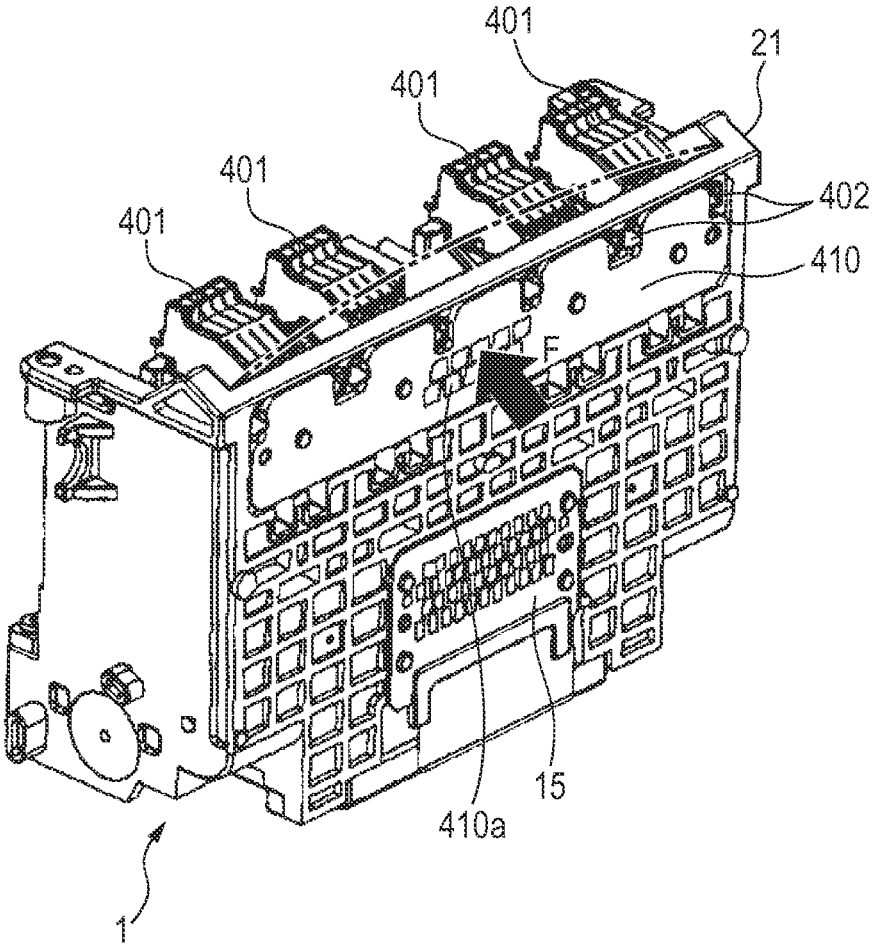
FIG. 5 is a schematic view of the wall of the housing where the electrical wiring substrate is rigidly secured, the wall being obtained by modifying the wall of the embodiment of FIGS. 4A, 4B, 4C, 4D, 4E, 4F and 4G.

In Comparative Example 1, the dimension of the housing 21 in the direction of sequential tank placement does not need to be increased if the first rib 41 is arranged in a space between the connectors 401 located behind or nearly behind the second tank 501 and also between the tank connection sections where the corresponding needles 202 are disposed. However, since the housing 21 is deformed to the largest extent at a center region of the rear side wall thereof as illustrated in FIG. 5, the first rib 41 is desirably formed in a center region of the rear side wall 21*a*. However, the space that allows the rib 41 to be arranged is found at a position close to a transversal end of the rear side wall 21*a* so that the stiffness of the rear side wall of the housing 21 is inevitably reduced if compared with the arrangement of the present invention (FIG. 6C).

In Comparative Example 2, on the other hand, the housing 21 is so designed that second tank 501 is placed at the left end of the housing 21 as illustrated in FIG. 6B. In this instance, the first rib 41 does not interfere with the snap fit joints 402 of the connectors 401 located near the first rib 41 if the first rib 41 is arranged in a space between the connectors 401 located behind and nearly behind the second tank 501 and also between the tank connection sections where the corresponding needles 202 are disposed. However, as in Comparative Example 1, the stiffness of the rear side wall of the housing 21 is inevitably reduced. If, on the other hand, the first rib 41 is arranged in a center region of the rear side wall 21*a* as illustrated in FIG. 6B in order to satisfactorily raise the stiffness of the rear side wall 21*a*, the first rib 41 interferes with those connectors 401. Then, as a result, those connectors 401 are required to be shifted in either of the transversal directions as in Comparative Example 1, to consequently increase the dimension of the housing 21 in the direction of sequential tank placement.

Contrary to Comparative Examples 1 and 2 that are described above, according to the present invention, the second tank 501 is arranged second from the left in the housing 21 as illustrated in FIG. 6C. The housing (liquid supply unit) is provided with first loading sections where first tanks 500 are to be loaded and a second loading section where a second tank 501 is to be loaded as seen from FIG. 6C. With this arrangement, a space is produced between the second connector 401 and the third connector 401 from the left and also between the tank connection section that is provided with the second needle 202 from the left and the tank connection section that is provided with the third needle 202 from the left and the space is located behind the second tank 501. Differently stated, a space is produced at or near the center region of the rear side wall 21*a* of the housing.

Therefore, if the first rib 41 is arranged at or near the center region of the rear side wall 21*a* of the housing 21, the first rib 41 does not interfere with any of the snap fit joints 402 of the connectors 401 so that the dimension of the housing 1 in the direction of sequential tank placement does not need to be increased significantly. Additionally, the stiffness of the rear side wall 21*a* where the second electrical wiring substrate 410 is rigidly secured is remarkably increased due to the first rib 41 located at the center of the rear side wall 21*a* so that the reliability of the electrical contact of the second electrical wiring substrate 410 can be held to a satisfactory level. Therefore, the liquid storing container having a relatively large width out of the plurality of liquid storing containers (ink tanks) to be loaded in parallel with in the liquid supply unit 10 is preferably loaded in a region not located at either of the opposite ends of the liquid supply unit 10. This is because the difference between the width of the liquid storing container and that of the connector 401 is large when the liquid storing container has a relatively large width so that the rib 41 can be arranged in a space produced due to the difference of width. Thus, when a plurality of liquid storing containers having two or more than two different widths are loaded in the liquid supply unit 10 of a liquid ejection head 1 according to the present invention, a liquid storing container other than the liquid storing container or containers having the smallest width is arranged at a position not located at either of the opposite ends of the liquid supply unit 10 and a rib is preferably arranged in the region of that liquid storing container. If two liquid storing containers having different widths are loaded in the liquid supply unit 10 of a laser device ejection head 1 according to the present invention, a rib is arranged in the region that corresponds to the liquid storing container having a relatively large width. In other words, when two liquid storing containers are loaded, a rib may be arranged at a position that corresponds to a liquid storing container located at an end of the liquid supply unit 10.

Additionally, the loading section where a liquid storing container having a relative large width is loaded is preferably arranged in a region that overlaps with the center of the rear side wall 21*a* in the transversal direction of the wall. As a rib 41 is formed at a position of the rear side wall 21*a* that overlaps with the liquid storing container having a relatively large width, the strength of the rear side wall 21*a* can be improved while preventing upsizing of the liquid supply unit (housing).

As pointed out earlier, a center section of the rear side wall 21*a* of the housing 21 as viewed in the transversal direction of the housing 21 can be deformed most. However, as illustrated in FIG. 5, the part of the rear side wall 21*a* of the housing 21 that corresponds to the inside of the region of the second electrical wiring substrate 410 where the contact pads 410*a* are arranged is subjected to the counterforce F of the electrode terminals (not illustrated) of the liquid ejection apparatus main body. In this embodiment, the second electrical wiring substrate 410 is arranged across the entire width of the rear side wall 21*a*. Additionally, the second electrical wiring substrate 410 is arranged along the top end of the rear side wall. Since the strength of the rear side wall 21*a* can be improved by such an arrangement, the connection reliability of the electrically connecting parts can also be improved. Furthermore, the first rib 41 is preferably arranged so as to pass through the region A2 of the second electrical wiring substrate 410 where the contact pads 410*a* are arranged.

The stiffness of the housing 21 is improved when the first rib 41 is extended forwardly until the first rib is linked with and orthogonally intersects the front wall 42 of the housing as illustrated in FIG. 8. Therefore, the first rib 41 is preferably provided with an extension 43, which is a part of the first rib 41, extending between the proper first rib 41 and the front wall 42 of the housing 21.

As illustrated in FIGS. 9A, 9B, 9C and 9D, the first rib 41 is preferably provided at an upper part (at an end in the longitudinal direction) thereof with a sloping surface 41*a* and the angle θ between the sloping surface 41*a* and the contact surface 44 of the housing 21 that is held in contact with the second electrical wiring substrate 410 is not less than 0 degrees and less than 90 degrees. This is because, when the housing 21 is loaded in the liquid ejection apparatus main body and if the sloping surface 41*a* is pressed (with load P) by a pressurizing means such as a spring, the counterforce F (load) from the electrode terminals at the side of the liquid ejection apparatus main body is offset so that the deformation, if any, of an upper part of the housing due to the counterforce F can remarkably be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112191, filed May 30, 2014 and Japanese Patent Application No. 2015-056151, filed Mar. 19, 2015 which are hereby incorporated by reference herein in their entirety.

What is claimed is:

1. A liquid ejection head comprising a housing to be removably loaded with a plurality of liquid storing containers so as to be arranged in a row and an ejection section for ejecting liquid, the liquid ejection head additionally comprising:

a plurality of liquid storing container connecting sections arranged in the inside of the housing so as to correspond to the liquid storing containers and become connected to the respective liquid storing containers in order to supply liquid to the ejection section;

an electrical wiring substrate rigidly secured to the outer surface of a wall of the housing opposite to a side of arrangement of the plurality of liquid storing container connecting sections so as to be electrically connected to electrode terminals; and a rib extending in a direction intersecting the direction of sequential placement of the plurality of liquid storing containers on the inner surface of the wall opposite to the outer surface, the plurality of liquid storing container connecting sections including one or more than one first liquid storing container connecting section, the first liquid storing container connecting section or each of the first liquid storing container connecting sections being formed so as to be connectable to a first liquid storing container but unconnectable to a second liquid storing container having a width greater than the width of the first liquid storing container as viewed in the direction of sequential placement, and a second liquid storing container connecting section formed so as to be unconnectable to the first liquid storing container but connectable to the second liquid storing container, and the rib being arranged at a position located adjacent to the second liquid storing container connecting section as viewed in the direction of sequential placement correspondingly in the region of the second liquid storing container to be connected to the second liquid storing container connecting section as viewed in the width direction of the second liquid storing container.

2. The liquid ejection head according to claim 1, wherein the electrical wiring substrate has contact pads to be electrically connected to the electrode terminals arranged at the outside of the liquid ejection head; and the rib is arranged so as to correspond to the region of the electrical wiring substrate where the contact pads are arranged.

3. The liquid ejection head according to claim 1, wherein the rib is partly extended to the wall of the housing disposed oppositely relative to the rib.

4. The liquid ejection head according to claim 1, wherein a sloping surface is formed at an end of the rib in the longitudinal direction thereof and the angle between the sloping surface and the surface that contacts the electrical wiring substrate on the outer surface of the housing is not less than 0° and less than 90°.

5. The liquid ejection head according to claim 1, wherein the second liquid storing container connecting section is shifted from the center of the second liquid storing container in the direction of sequential placement.

6. The liquid ejection head according to claim 1, further comprising:

a plurality of connectors rigidly secured to the inner surface at positions corresponding to the respective liquid storing containers and respectively electrically connected to the plurality of liquid storing containers that are connected with the plurality of liquid storing container connecting sections, the connectors running through the wall from the inner surface to the outer surface.

7. The liquid ejection head according to claim 1, wherein at least three liquid storing container connecting sections including the one or more than one first liquid storing container connecting sections and the second liquid storing container connecting section are sequentially placed and the second liquid storing container connecting section is arranged at a position not located at either of the opposite ends of the wall.

8. A liquid ejection head comprising:

an ejection section for ejecting liquid;

an electrical wiring substrate having terminals to be electrically connected to the respective electrical contacts of a liquid ejection apparatus;

a first loading section to be loaded with a first liquid storing container; and a second loading section to be loaded with a second liquid storing container having a width greater than that of the first liquid storing container, a wall of the liquid ejection head being provided with a rib extending in the height direction on the surface opposite to the surface mounted by the electrical wiring substrate, and the rib being arranged at a position corresponding to the second loading section.

9. The liquid ejection head according to claim 8, wherein the second loading section and the rib are arranged at respective positions where the second loading section and the rib overlap with each other as viewed in the first direction in which the second liquid storing container is to be loaded in the second loading section.

10. The liquid ejection head according to claim 8, wherein the second liquid storing container and the rib are arranged at respective positions where the second liquid storing container and the rib overlap with each other as viewed in the first direction in a state where the second liquid storing container has been loaded in the second loading section.

11. The liquid ejection head according to claim 8, wherein a first connector and a second connector to be respectively connected to the first liquid storing container and the second liquid storing container are arranged on the rear surface of the wall.

12. The liquid ejection head according to claim 11, wherein the rib and the second connector are arranged at respective positions that are shifted from each other in the width direction of the second liquid storing container as viewed in the first direction in which the second liquid storing container is to be loaded in the second loading section.

13. The liquid ejection head according to claim 11, wherein a second electrical wiring substrate to be connected to the first and the second connectors is arranged on the wall.

14. The liquid ejection head according to claim 13, wherein the second electrical wiring substrate is arranged above the electrical wiring substrate.

15. The liquid ejection head according to claim 13, wherein the second electrical wiring substrate is longer than the electrical wiring substrate in the direction of sequential arrangement in which the first and second loading sections are arranged.

16. The liquid ejection head according to claim 13, wherein the second electrical wiring substrate has a plurality of contacts to be electrically connected to the respective electrical contacts of a liquid ejection apparatus and the region where the plurality of contacts are arranged partly overlaps with the region where the rib is arranged.

17. The liquid ejection head according to claim 8, wherein at least three loading sections including the first loading section and the second loading section are arranged in parallel and the second loading section is arranged at a position not located at either of the opposite ends of the wall.

18. A liquid ejection head comprising:

an ejection section for ejecting liquid;

an electrical wiring substrate having terminals to be electrically connected to the respective electrical contacts of a liquid ejection apparatus;

a first loading section to be loaded with a first liquid storing container; and a second loading section to be loaded with a second liquid storing container having a width greater than that of the first liquid storing container, a wall of the liquid ejection head being provided with a rib extending in the height direction on a surface opposite to a surface mounted by the electrical wiring substrate, and the second loading section and the rib being arranged at respective positions where the second loading section and the rib overlap with each other as viewed in the direction of loading the second liquid storing container in the second loading section.

19. The liquid ejection head according to claim 18, wherein, the rib is arranged at a position separated from the second liquid storing container as viewed in the direction in which the wall extends in a state where the second liquid storing container has been loaded in the second loading section.

20. A liquid ejection head comprising:

an ejection section for ejecting liquid;

an electrical wiring substrate having terminals to be electrically connected to the respective electrical contacts of a liquid ejection apparatus;

a first loading section to be loaded with a first liquid storing container; and a second loading section to be loaded with a second liquid storing container having a width greater than that of the first liquid storing container, a wall of the liquid ejection head being provided with a rib extending in the height direction on a surface opposite to a surface mounted by the electrical wiring substrate, and the second liquid storing container and the rib being arranged at respective positions where the second liquid storing container and the rib overlap with each other as viewed in the direction of loading the second liquid storing container in the second loading section in a state where the second liquid storing container has been loaded in the second loading section.

* * * * *